US007184700B2

(12) United States Patent
Spilz et al.

(10) Patent No.: US 7,184,700 B2
(45) Date of Patent: Feb. 27, 2007

(54) METHOD OF DETERMINING COLOR REGISTER AND/OR REGISTER ERRORS IN A PRINTING MACHINE

(75) Inventors: Rolf Johannes Spilz, Gettorf (DE); Volker Otto, Gettorf (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 11/359,916

(22) Filed: Feb. 21, 2006

(65) Prior Publication Data

US 2006/0140686 A1 Jun. 29, 2006

Related U.S. Application Data

(63) Continuation of application No. PCT/US2004/026169, filed on Aug. 12, 2004.

(30) Foreign Application Priority Data

Aug. 18, 2003 (DE) ..... 103 37 861

(51) Int. Cl.
*G03G 15/00* (2006.01)

(52) U.S. Cl. ..... 399/395; 399/394; 399/301; 347/116

(58) Field of Classification Search ..... 399/301, 399/49, 395, 394; 347/116; 382/289; 400/579
See application file for complete search history.

(56) References Cited

U.S. PATENT DOCUMENTS

| | | | | |
|---|---|---|---|---|
| 4,552,066 | A | 11/1985 | Giori et al. | |
| 5,249,139 | A | 9/1993 | Blasius et al. | |
| 6,199,480 | B1 | 3/2001 | Leonhardt et al. | |
| 6,333,774 | B1 * | 12/2001 | Ito et al. | 355/26 |
| 6,721,528 | B1 * | 4/2004 | Schreieder et al. | 399/302 |
| 2002/0024681 | A1 * | 2/2002 | Leonhardt | 358/1.12 |
| 2003/0002891 | A1 * | 1/2003 | Metzler et al. | 399/301 |

FOREIGN PATENT DOCUMENTS

| | | |
|---|---|---|
| DE | 40 14 706 A1 | 11/1991 |
| EP | 1 048 461 A1 | 11/2000 |

* cited by examiner

*Primary Examiner*—David M. Gray
*Assistant Examiner*—Joseph S. Wong
(74) *Attorney, Agent, or Firm*—Laurence A. Greenberg; Werner H Stemer; Ralph E. Locher

(57) ABSTRACT

Color register and/or register errors are detected in a printing machine by using triangles serving as register marks. A first triangle is printed onto a sheet near the leading edge and a second triangle is printed onto a sheet near its trailing edge. The first triangle and the second triangle are detected by a sensor and a displacement of the sheet at right angles to the travel direction of the sheet and/or an angular displacement of the sheet is/are determined.

7 Claims, 2 Drawing Sheets

METHOD OF DETERMINING COLOR REGISTER AND/OR REGISTER ERRORS IN A PRINTING MACHINE

CROSS-REFERENCE TO RELATED APPLICATIONS

This is a continuing application, under 35 U.S.C. § 120, of copending international application PCT/US2004/026169, filed Aug. 12, 2004; the application, furthermore, claims the priority, under 35 U.S.C. § 119, of German patent application No. 103 37 861.8, filed Aug. 18, 2003. The prior applications are herewith incorporated by reference in their entirety.

BACKGROUND OF THE INVENTION

Field of the Invention

The invention lies in the printing technology field. More specifically, the invention relates in general to determining register errors, and more particularly to sensing printed triangles to determining color register and/or register errors in a printing machine.

In the printing industry, a number of print patterns or print images are transferred onto various printing media, usually onto various types of paper. In this process, the locational positioning of the print images is of great importance for the print quality. The locational positioning of each of the individual color applications, which combine to form a printed image in color, is also of great importance.

To achieve correct locational positioning, marks are used in the printing industry, which are usually imprinted onto the printing medium and which serve for one thing, as a comparison for detecting possible deviations of the printed image on the printing medium from the desired position. In another respect, the marks serve for detecting the position of the printing medium on the conveying mechanism and for determining whether that position of the printing medium on the conveying mechanism deviates from intended position. These marks are referred to as register marks in black on white printing, and as color register marks in color printing. When these marks are not located where they should be, the resultant deviation is called a register error or a color register error.

The location of the marks is measured and a determination is made from the measurement as to whether the printed image is properly positioned, whether the printing medium is properly positioned on the conveying mechanism, and/or the magnitude of any such deviation. Position deviations of the printed image, or the printing medium on the conveying mechanism that have been determined in this way can be appropriately corrected. In multi-color printing, for instance, during which several layers of color or color applications are printed one upon the other, marks are used for each individual color application. In the case of duplex printing, i.e., where the printing medium is imprinted on both sides (the first form side and the back side), the prior art art discloses the use of marks on the first form side as well as on the back side. These are detected separately.

The prior art includes a number of documents that propose using triangles as marks. By way of example, commonly assigned German patent application DE 40 14 706 and its counterpart U.S. Pat. No. 5,249,139 describe a process for detecting color register and/or register errors on a print product that contains marks. There, the marks are photo-electronically scanned as the print product passes through the printing machine.

SUMMARY OF THE INVENTION

It is accordingly an object of the invention to provide a method of effecting color register errors and register errors in a printing machine, which overcomes the above-mentioned disadvantages of the heretofore-known devices and methods of this general type and which suitably identifies color register and/or register errors during printing.

With the foregoing and other objects in view there is provided, in accordance with the invention, a method of determining register errors in a printing machine, the method which comprises:

printing at least one first triangle near a leading edge of a sheet;

printing at least one second triangle near a trailing edge of the sheet;

detecting the first triangle and the second triangle with a sensor; and deducing, from a location of the first triangle and the second triangle detected by the sensor, a displacement of the sheet transversely to a direction of travel of the sheet through the printing machine and/or an angular displacement of the sheet.

In other words, the invention provides a process for determining color register and/or register errors in a printing machine that uses an arrangement of triangles as marks, wherein at least one first triangle is imprinted near the leading edge of a sheet, and at least one second triangle is imprinted near the trailing edge of the sheet, the first triangle and the second triangle are detected by a sensor, and any displacement of the sheet that is at right angles to the sheet's direction of travel and/or any side to side displacement of the sheet is identified.

In one embodiment, the displacement of the sheet at right angles to the travel direction of the sheet and or the angular displacement of the sheet on the first form side thereof is/are identified, the sheet is turned over, and the displacement of the sheet at right angles to the sheet's direction of travel and/or the angular displacement of the sheet on the back side is/are identified.

In a further embodiment, the first triangle and the second triangle are detected through the sheet. In this way, it becomes unnecessary to imprint the marks on the back side and also when, after being turned over, the sheet passes through the printing machine for the second time, any shifting of the sheet on the back side, when compared to the first passage of the sheet on the first form side, can be detected.

Beneficially, a mechanism corrects the displacement of the sheet at right angles to the direction of travel of the sheet and/or the angular displacement of the sheet.

The process can be executed with particular ease if the position of the sheet is corrected such that the quotient of the distance $d_{1x}$ between the sides of the first triangle detected by the sensor and the distance $d_{2x}$ between the sides of the second triangle equals one. Using this criterion it is easy to determine whether the sheet is located in its error-free position on the transport belt.

Other features which are considered as characteristic for the invention are set forth in the appended claims.

Although the invention is illustrated and described herein as embodied in a method of determining register errors and/or color register errors in a printing machine it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DESCRIPTION OF THE PREFERRED EMBODIMENTS

Figure 1:
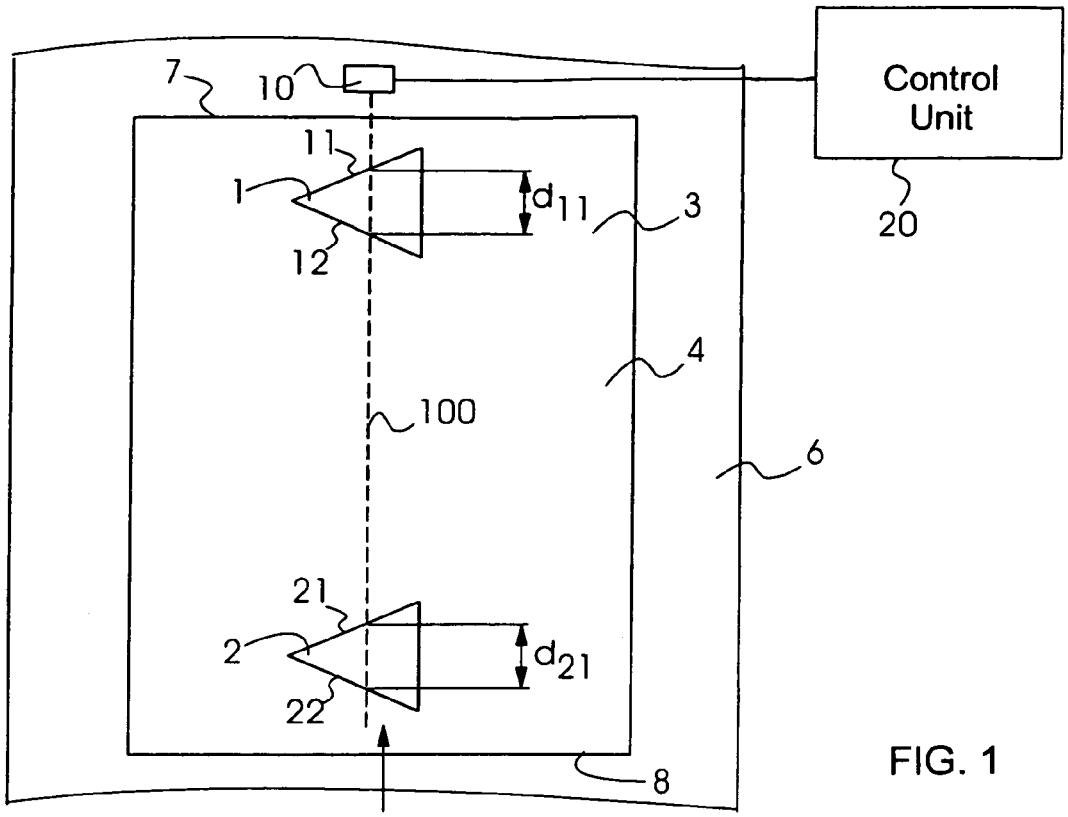
FIG. 1 is a plan view onto a first form side of a sheet on a transport belt on which a first triangle and a second triangle are shown, as they would appear as marks when the sheet is not displaced.

Referring now to the accompanying drawings in detail and first, particularly, to FIG. 1 thereof, there is shown an overhead view of the first form side of a sheet 3 that is being conveyed through a printing machine on a driven transport belt or conveyor belt 6 in the direction shown by the arrow. The transport belt 6 is usually an endless belt that is continuous and stretched over deflection and guide rollers. In the figures, only a section of the transport belt 6 is shown. In the printing mechanisms or printing modules of the printing machine, the sheet is imprinted with a first register mark, which is located near a leading edge 7 of the sheet 3. The first register mark is in the form of a triangle; this is a first triangle 1. A second register mark, also in the form of a triangle, is imprinted near a trailing edge 8 of the sheet 3. This is the second triangle 2. The shape of the second triangle should preferably be identical to that of the first triangle 1. In this example, the first triangle 1 and the second triangle 2 are equilateral triangles whose base lines run approximately parallel to the longitudinal side of the sheet 3 and to the direction of travel of the sheet 3.

Customarily, the marks (first triangle 1 and second triangle 2) serve to assure that the imprinted image on a printing medium, in this case, the sheet 3, is in color register and/or in register. The term "in register" refers to the proper positioning of an image imprinted on the printing medium. The term "in color register" refers to the proper positioning of a color image imprinted on the printing medium, sheet 3. The imprint will not be in color register or in register if the printing medium becomes undesirably displaced on its mechanism of conveyance, in this case, the transport belt 6, or if the imprint is applied at the wrong time. Above the transport belt, a sensor 10 is mounted, which detects the first triangle and the second triangle. For detecting the triangles 1 and 2, the sensor 10 identifies the light to dark transitions between the sheet 3 and the triangles 1 and 2. The line optically traversed by the sensor 10 is shown schematically by the dashed line 100. The sensor 10 is connected to the control mechanism or control unit 20 in the printing machine, which is schematically shown. The sensor 10 identifies the light to dark transitions for each of the two sides of triangles 1 and 2. In the first triangle 1, the sensor 10 identifies the light to dark transitions of the sides 11 and 12, and in the second triangle 2, the sensor 10 identifies the light to dark transitions of the sides 21 and 22.

The signals from the sensor 10 are transmitted to the control unit 20, in which the distances $d_{11}$ and $d_{21}$ can be calculated from the signals. The distance $d_{11}$ is the distance between the two sides 11 and 12 of the first triangle 1, through which the dashed line 100 passes and which are detected by the sensor 10. The distance $d_{21}$ is the distance between the two sides 21 and 22 of the second triangle 2, through which the dashed line 100 passes and which is detected by the sensor 10. In the control unit 20, clock pulses are counted which are governed by signals from the sensor 10 and which begin in each case when the first side of the triangles 1 and 2 are detected and stop when the second side of these triangles 1 and 2 are detected. The clock pulses that are counted in this way are correlated with a distance $d_{11}$ or $d_{21}$.

If the triangles 1 and 2 are displaced, the distances between the sides 11 and 12, and 21 and 22 that are detected by the sensor 10 are changed. In such case, the sensor 10 detects the sides 11 and 12, and 21 and 22 of the triangles 1 and 2 at different points on these sides. In FIG. 1, the sheet 3 is located in an error-free orientation relative to the transport belt 6, the sheet 3 is not displaced, and the first triangle 1 and the second triangle 2 have been imprinted at the correct locations on the sheet 3. Provided that the first triangle 1 and the second triangle 2 are identical in size and have the same orientation on the sheet 3, i.e., the distances of the triangles 1 and 2 to the longitudinal side of the sheet 3 and the orientations of the angles of the triangles 1 and 2 on the sheet 3 are also identical, the distances $d_{11}$ and $d_{21}$ which are detected by the sensor 10 will be the same.

In such case, then, in which the sheet 3 is being conveyed error free on the transport belt 6 without any angular shift, the quotient derived from the distances $d_{11}$ and $d_{21}$ equals one. This quotient is calculated in the control unit 20. Thus, a simple criterion is available for determining the error-free angular orientation of the sheet 3. If the quotient calculated using the distances $d_{11}$ and $d_{21}$ is equal to one, the sheet 3 is conveyed error-free relative to its angular position on the transport belt 6. If, however, the quotient calculated using the distances $d_{11}$ and $d_{21}$ does not equal one, the sheet 3 is being conveyed on the transport belt at a skew, an incorrect angle. Angular displacements are thus determined with the aid of the afore-mentioned quotient. Angular displacements of the sheet 3 are specifically determined by correlating the value of the calculated quotient with values found in a correlation table contained in the control mechanism 20.

An angle $\alpha$, by which the triangles 1 and 2 and, thus, the sheet 3 on the transport belt 6 are displaced, is specifically assigned to each calculated quotient. It always is a prerequisite in this regard that the positions of the triangles 1 and 2 on the sheet 3 are perfect, i.e., the triangles 1 and 2 are imprinted error-free on precisely the correct locations on the sheet 3. This prerequisite is met when the sheet 3 is oriented on the transport belt 6 directly before the print 3 is imprinted with the triangles 1 and 2. In addition, a displacement of the sheet 3 that is at right angles to its direction of travel, the so-called cross-track, is determinable. If the sheet 3 is displaced at right angles to its direction of travel, the distances $d_{11}$ and $d_{21}$ change equally, provided that the sheet 3 is not angularly displaced. For example, a shifting of the sheet 3 in FIG. 1 toward the left, at right angles to the direction of travel of the sheet 3, results in an increase of the distances $d_{11}$ and $d_{21}$ because the triangles 1 and 2 in such case lie such that the sides of the triangles spread out in a rightward direction. A shifting of the sheet 3 in FIG. 1 toward the right, for example, and at right angles to the direction of travel of the sheet 3, results in a decrease of the distances $d_{11}$ and $d_{21}$. In the control mechanism, the distances $d_{11}$ and $d_{21}$ are assigned specifically to values for a displacement of the sheet 3 at right angles to the direction of travel.

Figure 2:
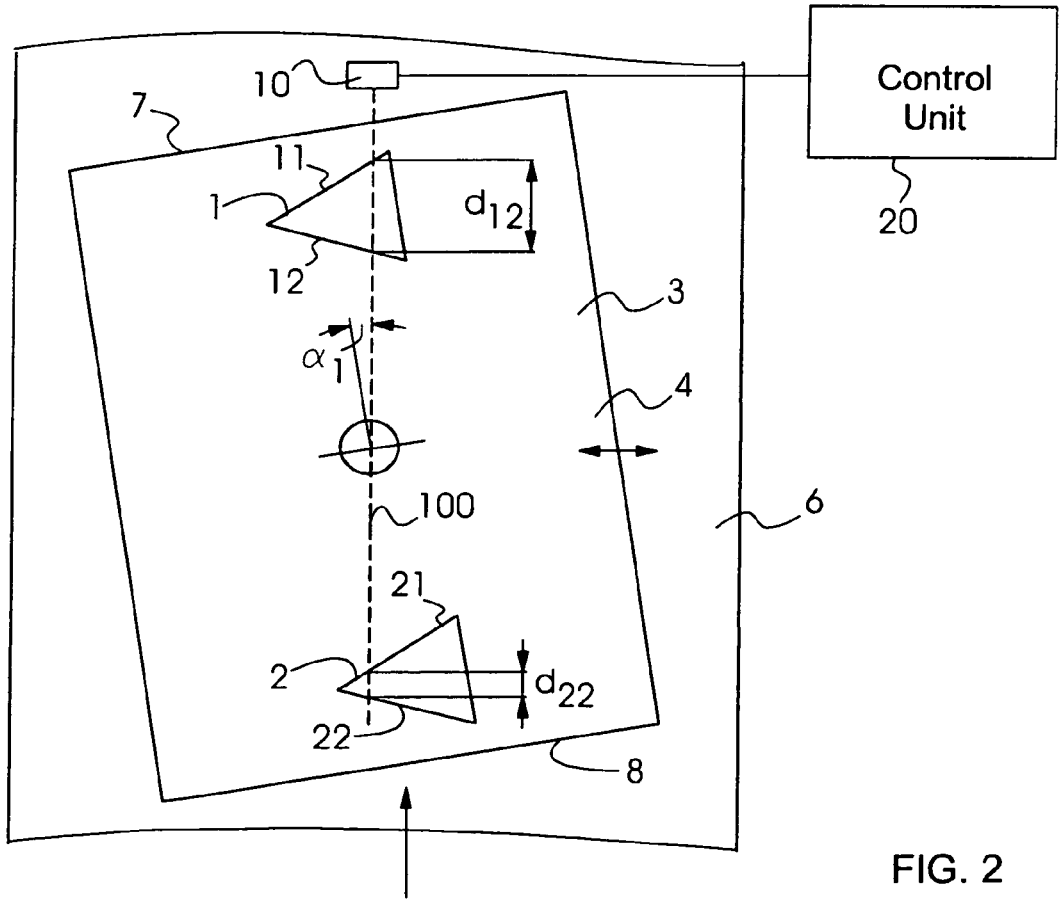
FIG. 2 is a plan view onto the first form side of a sheet on the transport belt, on which a first triangle and a second triangle are shown as they would appear as marks when the sheet is displaced.

FIG. 2 shows an overhead view of the first form side of the sheet 3 that is similar in some respects to FIG. 1. The first triangle 1 and the second triangle 2 have sides of equal length, have equal sizes, and their base sides run at equal distances from and parallel to the longitudinal side of the sheet 3, as was also the case in FIG. 1. The first triangle 1 is located close to the leading edge 7 of the sheet 3 and the second triangle 2 is located close to the trailing edge 8. In this representation, the sheet 3 is skewed, i.e., it is displaced on the transport belt 6 by an angle $\alpha_1$ from its center point; there is no displacement of the sheet 3 on the transport belt in the plane that is at right angles to the direction of travel. A displacement of the sheet 3 in the direction of its travel is not covered by the invention.

In FIG. 2, an angular displacement of the sheet 3 is present during the first passage of the sheet 3 through the printing machine in the perfector print operation, whereby the first form side is up, whereas in the preferred embodiments, the sheet 3 becomes oriented error-free on the transport belt 6 and is immediately thereafter imprinted with the triangles 1 and 2. In such case, the sheet 3 lies error-free on the transport belt 6 with its first form side up and an angular displacement such as that shown in FIG. 2 does not take place. Because of the displacement of the sheet, the sensor 10 detects the first triangle 1 at different points of intersection on the triangle 1 to the background formed by the sheet 3 than is the case in FIG. 1. As a consequence, the distance $d_{12}$ between the points on the sides 11 and 12 of the first triangle 1 is different from the corresponding distance $d_{11}$, i.e., when the sheet 3 has shifted angularly, the distance $d_{11}$ does not equal the distance $d_{21}$. In the instant case as shown in FIG. 2 the distance $d_{12}$ is greater than the distance $d_{11}$. The same applies to the second triangle 2, whereby the sensor 10 measures a distance $d_{22}$ from the first side 21 relative to the direction of travel to the second side 22 of the second triangle 2, wherein the distance $d_{22}$ is greater than the distance $d_{21}$. With the aid of the existing distances $d_{12}$ and $d_{22}$ for the first triangle 1 and the second triangle 2, respectively, the angular displacement a1 of the sheet 3 on the transport belt 6 is specifically determined in the control unit 20.

The quotient of the distances $d_{12}$ and $d_{22}$ is calculated in the control unit 20. The quotient thus calculated is then correlated with a value for an angle in the correlation table that corresponds to the angular displacement of the sheet 3, which in the instant example is the angle $\alpha_1$. A displacement of the sheet 3 on the transport belt 6 that is at right angles to its direction of travel in the direction of the two-pointed arrow results in changes in the distances $d_{12}$ and $d_{22}$ that are detected by the sensor 10. In this case, too, the quotient of the distances $d_{12}$ and $d_{22}$ is calculated in the control mechanism whereby this quotient is correlated with a displacement path at right angles to the direction of travel of the sheet 3. If the sheet 3 is shifted exclusively at right angles to its direction of travel, the quotient derived from the distances $d_{12}$ and $d_{22}$ remains constant.

Figure 3:
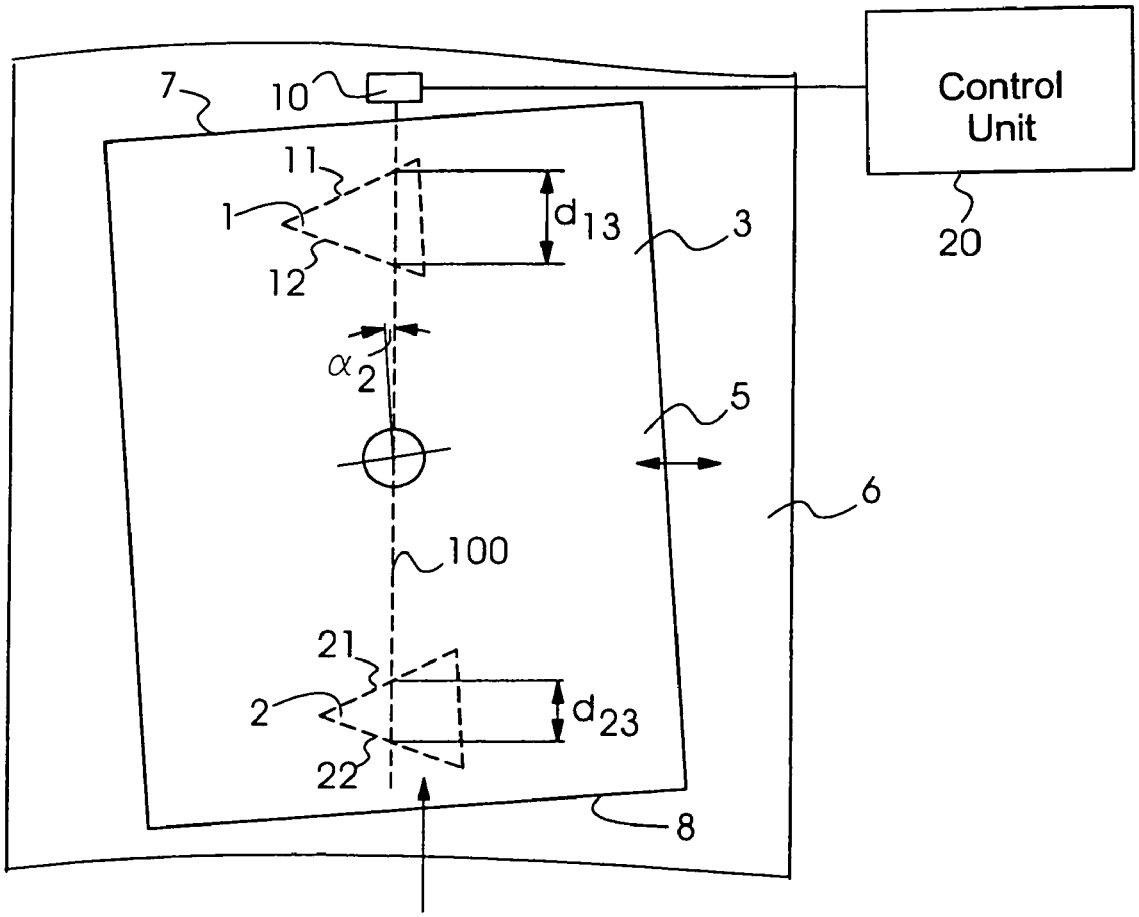
FIG. 3 is a plan view onto a back side of a sheet on the transport belt, on which a first triangle and a second triangle are shown as they would appear as marks when the sheet is displaced.

FIG. 3 shows an overhead view of the back-side of the sheet 3 on the transport belt 6 along with the first triangle 1 and the second triangle 2, which are used as marks as they were in FIG. 2. Here, the sheet 3 has already been run through the printing machine and has been turned over for perfector printing. It should be noted here, that after being turned over such that the back-side is now facing upward, the sheet 3 is not once again imprinted with marks. Instead, the sensor 10 detects the triangles 1 and 2, which have already been imprinted on the sheet 3, through the sheet 3. It is also possible for the second sensor to be mounted underneath both the sheet 3 and the transport belt 6, and this sensor, instead of the sensor 10, would then detect the triangles 1 and 2, wherein the two sensors would be aligned with one another and would detect the triangles 1 and 2 at the same places relative to the transport belt 6. In the present case, the transport belt 6, having only one sensor, is transparent. Here, the sheet 3 has experienced a wider angular displacement in its passage through the printing machine than was the case in FIG. 2, i.e., the angular displacement here is now $\alpha_2$, which is not equal to $\alpha_1$, whereby the angles from the longitudinal side of the sheet 3 are measured.

In the preferred embodiment of the invention, in which the triangles 1 and 2 are imprinted directly after the sheet 3 has been correctly aligned on the transport belt 6, the angle $\alpha_2$ is the only angular displacement of the sheet 3, and the angle $\alpha_1$ equals zero. The distances $d_{13}$ and $d_{23}$ are measured as described above and then transmitted to the control mechanism. In the control mechanism 20, the distances $d_{13}$ and $d_{23}$ are compared with the distances $d_{11}$ and $d_{12}$, which represent the error-free distances. The results of this comparison show whether the sheet 3 became displaced on the transport belt between the detection by the sensor 10 of the triangles 1 and 2 on the first form side and the detection of the triangles 1 and 2 after the sheet 3 had passed through the printing machine and had been turned over. If, for example, the measured distances $d_{13}$ and $d_{11}$ and $d_{23}$ and $d_{21}$ are the same, the sheet 3 will not have been displaced during its passage through the printing machine, the position of the sheet 3 on the transport belt will not have changed, and a correction of the position of the sheet 3 on the transport belt will not be necessary. If the distance $d_{13}$ is different from $d_{11}$ and/or $d_{23}$ is different from $d_{21}$, then the sheet 3 will have been displaced on the transport belt 6 between the detection that took place when the first form side was up and the detection after passage through the printing machine, that was followed by turning the sheet 3 over in perfector printing. The distances $d_{11}$ and $d_{21}$ indicate the distances of the first triangle 1 or the second triangle 2, respectively, in the error-free situation as shown in FIG. 1; these distances are stored in the control mechanism 20. The differences in values between the detected distances of the first triangle 1, i.e., $d_{11}$ and $d_{13}$, and of the second triangle 2, i.e., $d_{21}$ and $d_{23}$ are calculated. These differential values are correlated in the correlation table of the control mechanism 20 with a displacement of the sheet 3, as described above. Thus, the angle $\alpha_2$ is determined, which identifies the angular displacement of the sheet 3 on the transport belt 6, which occurred during the passage of the sheet 3 through the printing machine. This displacement is then corrected before the sheet 3 is conveyed to the printing mechanisms or printing modules of the printing machine and printed on the back-side.

We claim:

1. A method of determining register errors in a printing machine, the method which comprises:

printing at least one first triangle near a leading edge of a sheet;

printing at least one second triangle near a trailing edge of the sheet;

detecting the first triangle and the second triangle with a sensor;

deducing, from a location of the first triangle and the second triangle detected by the sensor, a displacement of the sheet transversely to a direction of travel of the sheet through the printing machine and/or an angular displacement of the sheet.

2. The method according to claim 1, which comprises determining a color register error.

3. The method according to claim 1, which comprises determining a displacement of the sheet in a direction perpendicular to the direction of travel.

4. The method according to claim 1, which comprises:

determining the displacement of the sheet transversely to the direction of travel on a first form side thereof;

subsequently turning the sheet over; and determining a displacement of the sheet transversely to the direction of travel of the sheet and/or an angular displacement of the sheet on a back side thereof.

5. The method according to claim 4, which comprises detecting the first triangle and the second triangle through the sheet.

6. The method according to claim 1, which further comprises correcting at least one of a displacement of the sheet transversely to the direction of travel of the sheet and an angular displacement of the sheet.

7. The method according to claim 6, which comprises:

measuring with the sensor a distance $d_{1x}$ between two sides of the first triangle and a distance $d_{2x}$ between two sides of the second triangle;

continuing to correct a position of the sheet until a quotient of the distance $d_{1x}$ and the $d_{2x}$ equals 1.

* * * * *